US007947857B2

(12) United States Patent
Nazari et al.

(10) Patent No.: US 7,947,857 B2
(45) Date of Patent: May 24, 2011

(54) STABILIZATION OF GAS HYDRATES

(75) Inventors: Khodadad Nazari, Tehran (IR); Hosein Rahimi, Tehran (IR); Ramin Khodafarin, Tehran (IR); Mohammad Kameli, Tehran (IR); Hosein Brijanian, Tehran (IR)

(73) Assignee: Research Institute of Petroleum Industry (RIPI), Tehran (IR)

( * ) Notice: Subject to any disclaimer, the term of this patent is extended or adjusted under 35 U.S.C. 154(b) by 271 days.

(21) Appl. No.: 12/200,517

(22) Filed: Aug. 28, 2008

(65) Prior Publication Data

US 2009/0062579 A1 Mar. 5, 2009

(30) Foreign Application Priority Data

Aug. 29, 2007 (EP) ..... 07115239

(51) Int. Cl.
*C10L 3/10* (2006.01)
*C10L 3/00* (2006.01)

(52) U.S. Cl. ..... 585/15; 137/13

(58) Field of Classification Search ..... 585/15
See application file for complete search history.

(56) References Cited

U.S. PATENT DOCUMENTS

| | | | | |
|---|---|---|---|---|
| 3,975,167 | A | 8/1976 | Nierman | |
| 4,915,176 | A | 4/1990 | Sugier et al. | |
| 5,536,893 | A | 7/1996 | Gudmundssun | |
| 5,880,319 | A | 3/1999 | Sloan, Jr. | |
| 6,035,933 | A * | 3/2000 | Khalil et al. | 166/263 |
| 6,082,118 | A | 7/2000 | Endrizzi et al. | |
| 6,756,345 | B2 * | 6/2004 | Pakulski et al. | 507/246 |
| 6,867,262 | B1 * | 3/2005 | Angel et al. | 525/326.9 |
| 7,067,459 | B2 * | 6/2006 | Pakulski et al. | 507/90 |
| 2003/0130454 | A1 | 7/2003 | Seya et al. | |
| 2006/0223713 | A1 * | 10/2006 | Pakulski et al. | 507/132 |

FOREIGN PATENT DOCUMENTS

| | | |
|---|---|---|
| EP | 1717288 | 11/2006 |
| GB | 2301839 | 12/1996 |
| GB | 2347938 | 9/2000 |
| WO | 93/01153 | 1/1993 |
| WO | 97/13824 | 4/1997 |
| WO | 01/00755 | 1/2001 |

OTHER PUBLICATIONS

Sloan Jr, "Fundamental Principles and Applications of Natural Gas Hydrates." Nature, vol. 426, Nov. 20, 2003, pp. 353-359.
Stern et al., "Preservation of Methane Hydrate at 1 Atm." Energy and Fuels, 15, 2001, pp. 499-501.
Tse et al., "Formation and Decomposition Mechanisms for Clathrate Hydrates." Journal of Supramolecular Chemistry, 2, 2002, pp. 467-472.
Satoshi et al., "In Situ X-Ray Diffraction Measurements of the Self-Preservation Effect of CH4 Hydrate." J. Phys. Chem A, 105, 2001, 9756-9759.
Kuhs et al., "Ice Perfection and Onset of Anomalous Presevation of Gas Hydrates." Phys Chem. Chem. Phys., 6, 2004, 4917-4920.

* cited by examiner

*Primary Examiner* — Ellen M McAvoy
(74) *Attorney, Agent, or Firm* — Kenyon & Kenyon LLP

(57) ABSTRACT

Provided are compositions and methods for increasing the stability and gas content of gas hydrates.

42 Claims, 4 Drawing Sheets

STABILIZATION OF GAS HYDRATES

CROSS REFERENCE

The present application claims the benefit of EP 07 115 239.1, filed on Aug. 29, 2007, whose content is incorporated by reference herein in its entirety.

FIELD OF THE INVENTION

The present invention relates to the filed of gas stabilization and storage.

BACKGROUND OF THE INVENTION

Gas hydrates are ice-like non-stoichiometric crystalline compounds. These are cages of water molecules, formed around guest molecules, which are simply called hydrates in gas and oil industries.

The conditions necessary for the formation of hydrates include the presence of water or ice, the presence of a non-polar gas or liquid or a gas or liquid of low polarity and of course proper temperatures and pressures. Water molecules form cages around the guest molecule, as a result of their hydrogen bonding, however they form no chemical bonds with the guest. The gaseous guest molecules are actually compressed and trapped in this porous structure, giving it the potential for storing gas compounds and for their transportation [Sloan, Jr. D., "Fundamental Principles and Applications of Natural Gas Hydrates", *Nature,* 246(6964), 353-359 (2003).].

Hydrates of interest in industries, especially in the production and processing of natural gas and oil, are composed of water and guest molecules, such as for example methane, ethane, propane, iso-butane, normal butane, nitrogen, carbon dioxide, hydrogen sulfide and/or hydrogen [Sloan, Jr. D., "Fundamental Principles and Applications of Natural Gas Hydrates", *Nature,* 246(6964), 353-359 (2003).]. Other guest species like for example ethylene, $N_2O$, acetylene, vinyl chloride, methane halides, ethane halides, cyclo-propane, methyl mercaptanes, sulfur dioxide, Ir, Ar, Xe, oxygen, trimethylene oxide etc. can also form hydrate clathrates.

Additives having different properties can be used during the formation of gas hydrates. Compounds prohibiting the formation of such structures are so called hydrate inhibitors. One may distinguish between two groups of thermodynamic inhibitors, such as for example methanol, glycols and others that avoid the formation of hydrates by shifting the phase diagram of the system and kinetic inhibitors, such as for example polyvinyl pyrrolidone, which postpone the formation of hydrates up to some days.

Other types of additives having a rather opposite effects are also known and are so called hydrate promoters, such as for example sodium dodecyl sulfate promoting the formation of hydrates.

The major problem with the application of natural gas as a fuel is its transportation, because of its low density, i.e. small amounts of natural gas have high volumes. One solution to this problem is the high-pressure storage of natural gas, which is performed in two distinct methods of liquefied natural gas (LNG) and compressed natural gas (CNG), depending on the transportation systems used. LNG is very expensive from a process equipment and transportation equipment point of view. CNG on the other hand, is not a suitable method for gas transportation due to the high volume of the compressed gas.

Conversion of methane to methanol, which is a liquid and easily transportable fuel, might be an alternative but it is not a proper method due to the high costs and the required operations loosing of up to 47% of the heat value of natural gas.

The production of hydrates for storing the hydrocarbon gases can be another alternative. This will be a less costly method with higher levels of safety and will require less energy and equipment for forming the hydrate and dissociating it at the final destination. It is also safer than the traditional methods of LNG and CNG, which always accompany the risk of explosion, especially in the case of accidents.

The major problems of using hydrates for the purpose of making gases transportable is the high pressure necessary for forming, storing, and transporting the hydrates. Numerous efforts have been made to solve this problem and one solution proposed is the application of slurry hydrates that are formed by gradual addition of gases to water, suggested in U.S. Pat. No. 6,082,118. This method however, suffers drawbacks including a low final gas content that make it expensive and not economic.

Stern L. A, et al (Energy and Fuels 15(2), 2001, 499-501) and Tse (J. Supramol. Chem., 2, 2002, 467-472) reported that decreasing the pressure over the hydrates leads to their decomposition, and because this is an endothermic process, the molten layer of the hydrate converts to ice, protecting the remaining hydrate, which is entitled the self-preservation phenomenon. Stern L. A. paid specific attention to the stabilization of methane hydrates in 50-75° over the equilibrium temperature (193 K) and under atmospheric pressure, using pressure release methods.

Satoshi T., (J. Phys. Chem. A, 105(42), 2001, 9756-9759) reported that the bigger the size of the hydrate particles is, the higher the probability of keeping hydrates under higher temperatures will be. For example, they mentioned that for hydrate particles of 1000-1400 μm in dimension, a low gas content of only about 20% (v/v) of methane can be achieved in 263 K and 1 atm.

Stern et al, (Energy & Fuels, 15 (2), 2001, 499-501), Tse, et al., (J Supramol. Chem., 2, 2002, 467-472), and Kush et al., (Phys Chem. Chem. Phys., 6(27), 2004, 4917-4920) suggested using the self-preservation property of hydrates. This method suffers disadvantages, like low stability, conversion of hydrate to ice, and their low gas content.

U.S. Pat. No. 3,975,167 describes a method for forming hydrates by a special process and apparatus, which provide the temperature and pressure for the formation the hydrate in a suitable depth of the sea. According to this invention hydrates are formed using proper cooling systems and through providing the required pressure by choosing the proper depth in water. The gas is released in the destination by bringing the hydrate to the surface and heating it. However, also expensive equipment is necessary for such processes.

U.S. Pat. No. 5,536,893 describes a method for forming and transportation of hydrates. This patent discloses the details of the system and process of production of hydrates from water and gas. The method is based on spraying water and cooled gas, which is followed by hydrate formation, its removal from the reactor, its agglomeration, increasing its density, saturation of its pores with the gas and finally its storage or transportation.

But this method is used under very difficult-to-achieve adiabatic conditions. The hydrate storage is performed outside the thermodynamic hydrate stabilization area shown in FIG. 1 on the same text (−10-150° C. and atmospheric pressure), which naturally leads to the ice-formation on the surface of the hydrate phase, and the reduction of gas storage capacity of the formed hydrates, according to hydrate-phase thermodynamic principles.

The recovered gas, in addition, is only 20-70% of what is initially stored, which is not directly mentioned in the patent, but is actually expected to be very low due to the inevitable hydrate storage conditions.

U.S. Pat. No. 6,082,118 storage and transportation of slurry hydrates suspended in liquid hydrocarbons under metastable conditions are disclosed. The hydrates formed in this invention, however, have low gas contents.

The stability of hydrates is defined by their inherent phase diagrams. Gas hydrates have high stabilities at high pressures (e.g. 150 bar) and low temperatures (e.g. 4° C.). It should also be noted that the pressure should be adjusted with using the same gases as for the desired hydrates in order not to disrupt the thermodynamic equilibrium of the existing phases. Given that the phase boundary curves of gas hydrates are of exponential nature, the so-called hydrate formation zone is much wider at higher pressures.

For instance, taking 0° C. as the reference temperature the methane hydrates formed under a pressure of 100 bar will be stable in a temperature range of from 0-13° C., while if the pressure is reduced to 50 bar, methane hydrate will be stable only in the range of 0 to 5.8° C., as described in FIG. 1.

Temperatures below 0° C. bear the risk of ice-formation, which leads to the release of the gases stored in the primary hydrate structure. The advantage of high pressures is that by adjusting the system composition in a way that water is the limiting reactant, all of the water can be converted to hydrates that are highly saturated with gas molecules. But even at high pressures (e.g. 150 bar for $CH_4$), and in particular at low pressures, the hydrate pores are not filled with the gas molecules, and the gas content of the hydrate is not high. Additional tests also show that hydrates formed through the above-mentioned methods known in the art suffer disadvantages, like low gas-contents, low mechanical stability, low yield, and long equilibrium times in the hydrate formation process.

On the other hand, although the formation of hydrates at high pressures and low temperatures (e.g. 250 bar, and 4° C.) is favorable, transportation of gases in hydrates under such high pressures can be highly dangerous.

Many efforts have been made to use the hydrate self-preservation phenomenon in order to make it possible to store hydrates under milder conditions, like atmospheric pressure up to 30 bar. In order for the storage pressure to be 1 bar, the system temperature must be reduced to −20° C. or lower (e.g. −40° C.), which is very costly, and also causes the disadvantage of the ice-formation, as well as the fact that the formed hydrates will have low gas contents.

In general the storage pressure and gas content of hydrates are important factors in storage conditions. It is noteworthy that the higher the gas content of a hydrate is, the faster its dissociation will be.

One would also realize that, although the hydrate self-preservation is a fully understood phenomenon, there is no data available on the long-term stabilization of hydrates in or out of the thermodynamic stability conditions of hydrates.

Hydrates start to change to ice at temperatures below zero (0° C.), especially between 0 to minus 33° C. This has been proved by neutron diffraction spectroscopy [Kush. W F, et al, Phys. Chem. Phys. 6(21), 2004, 4917-49201]. The ice particles formed in the temperature range of from 0 to minus 33° C. are of hexagonal ($I_h$) crystalline structure, and their agglomeration prohibits the gas from leaving the hydrate structure. Below −33° C., cubic ice ($I_C$) is formed, which has far less agglomeration, and hence a far less ability of blocking the gases, and the hydrates are hence gradually dissociated.

There exists a strong need to prepare hydrates with high gas contents and achieve good stability allowing their transportation at conditions that are relatively "mild", such as for example low pressure. Also, further drawbacks described above according to the prior art should be resolved.

SUMMARY OF THE INVENTION

In one embodiment, the present invention provides a composition for increasing stability and gas content of gas hydrates comprising:

a. water;

b. a gas;

c. a stabilizer that is an organic compound (which can be in the form of a polymer) having both hydrophillic and hydrophobic portions, wherein the stabilizer results in an increase in at least one of stability or gas content of the gas hydrate.

The composition can further comprise a hydrate promoter, such as sodium dodecyl sulphate. The composition can further comprise a hydrate inhibitor, such as polyvinylpyrrolidone. The hydrate stabilizer can be selected from the group consisting of cellulosic ethers, polyalkylene glycols, polyamines, polyvinylpyrroli-done, polyamides, polypeptides, ethoxylated fatty amines, ethoxylated fatty acids; sulphonated, phosphonated or ethoxylated water soluble polymers and mixtures thereof. The hydrate stabilizer can be selected from the group consisting of hydroxy allyl cellulose derivative, polypropylene glycol, polyethylene glycol, polyethylene amine, polypropylene amine, polyaniline, ethoxylated polyamines, polyaminoacids, and combinations thereof. The hydrate stabilizer can be selected from the group consisting of hydroxyethyl cellulose, hydroxypropyl cellulose, hydroxypropyl methylcellulose, carboxymethylcellulose and combinations thereof. The stabilizer can be a cellulosic ether. The stabilizer can be a hydroxyalkyl cellu-lose. The stabilizer can be hydroxyethyl cellulose and/or hydroxypropyl methylcellulose. The stabilizer can have a molecular weight of 5,000 to 1,000,000. The stabilizer can be present in an amount of 0.1 to 1% by weight in relation to the amount of water, or in an amount of 0.3 to 0.8% by weight in relation to the amount of water, or in an amount of 0.5% by weight in relation to the amount of water. The hydrate stabilizer can be cellulose ether. The hydrate stabilizer can be a polyalkylene glycol.

The hydrate stabilizer can be poly-ethylene glycol. The hydrate stabilizer can be a polyalkylene glycol having a molecular weight of 300 to 300,000. The hydrate stabilizer can be a polyalkylene glycol and be present in an amount of 0.3 to 1.2% by weight, or 0.4 to 0.9% by weight, or 0.6% by weight in relation to the amount of water. The hydrate stabilizer can be a polylysine. The hydrate stabilizer can be a mixture of polyeth-ylene glycol, hydroxyethyl cellulose, hydroxypropyl cellulose, and hydroxypropyl methyl cellulose, wherein the concentration of hydroxyethyl cellulose is 0.1%-0.4% by weight, the concentration of hydroxypropyl cellulose is 0.1%-0.2% by weight, the concentration of hydroxypropyl methyl cellulose is 0.1%-0.3% by weight and the concentration of polyethylene glycol is 0.1% to 0.4% by weight in relation to the amount of water.

Preferably, the concentration of hydroxyethyl cel-lulose is 0.2% by weight, the concentration of hydroxypropyl cellulose is 0.1% by weight, the concentration of hydroxypropyl methyl cellulose is 0.1% by weight and the concentration of polyethylene glycol is 0.2% by weight in relation to the amount of water. The stabilizer can comprise 0.1 to 1.2% by weight of polyalkylene glycols in relation to the amount of water. Or 0.4 to 0.9% by weight in relation to the amount of water, or 0.6% by weight of polyalkylen glycol in relation to the amount of water. The gas can be selected from the group consisting of methane, ethane, propane, iso-butane, acetylene, ethyl-ene, cyclopropane, natural gases or any other mixtures of hydrocarbons or other volatile compounds like $O_2$, $N_2$, $CO_2$, $SO_2$, $SO_3$, noble gases, $H_2S$, ni-trogen oxides and $H_2$ and mixtures thereof.

30. The composition according to claim 1, wherein the gas is selected from the group consisting of hydrocarbons, natural gases, hydrogen, noble gases and carbon oxides and mixtures thereof. The gas can be methane. The gas can be carbon dioxide. The gas can be natural gas.

In one embodiment, the present invention provides a process for production of gas hydrates comprising the steps of a. dissolving the stabilizer in distilled water,
b. mixing the stabilizer solution with a gas to obtain a mixture,
c. pressurizing said mixture with the same gas,
d. reducing temperature to 1-4° C. to form hydrates,
e. adjusting the temperature to (−10° C.)-(+5° C.),
f. reducing the pressure to a desired storage pressure.

The gas can be methane or natural gas and the storage pressure is 13 bar. The gas can be methane or natural gas and hydrate formation can take place at 120 bar. The gas can be carbon dioxide and the storage pressure can be 7 bar.

The gas can be carbon dioxide and hydrate formation can take place at 50 bar.

In one embodiment, the present invention provides a method of stabilizing gas hydrates, wherein a stabilizer is added to the mixture selected from the group of cellulosic ethers (e.g. hydroxyethyl cellu-lose, hydroxypropyl cellulose, hydroxypropyl methylcellulose, carboxymethylcellulose), hydroxy alkyl cellulose derivatives, polyalkylene glycols (e.g. polypropylene glycol, polyethylene glycol), polyamines (e.g. polyethyl-ene amine, polypropylene amine, polyamines, polyamides, polyaniline, eth-oxylated polyamines), polyvinylpyrroli-done, polypeptides (e.g. polylysine), ethoxylated fatty amines, ethoxylated fatty acids; sulphonated, phospho-nated or ethoxylated water soluble polymers or mixtures of the above men-tioned compounds.

In one embodiment, the present invention provides a method for the stabilization of gas hydrates comprising the steps of a. dissolving a hydrate promoter in water,
b. applying high gas pressure to the solution until hydrate forming has finished,
c. adding a solution of a hydrate inhibitor.
e. adjusting the temperature to (−10° C.)-(+5° C.),
f. reducing the pressure to the suitable storage pressure.

The hydrate promoter can be sodium dodecyl sulphate. The hydrate inhibitor can be polyvinylpyrrolidone.

DETAILED DESCRIPTION OF THE INVENTION

Figure 1:
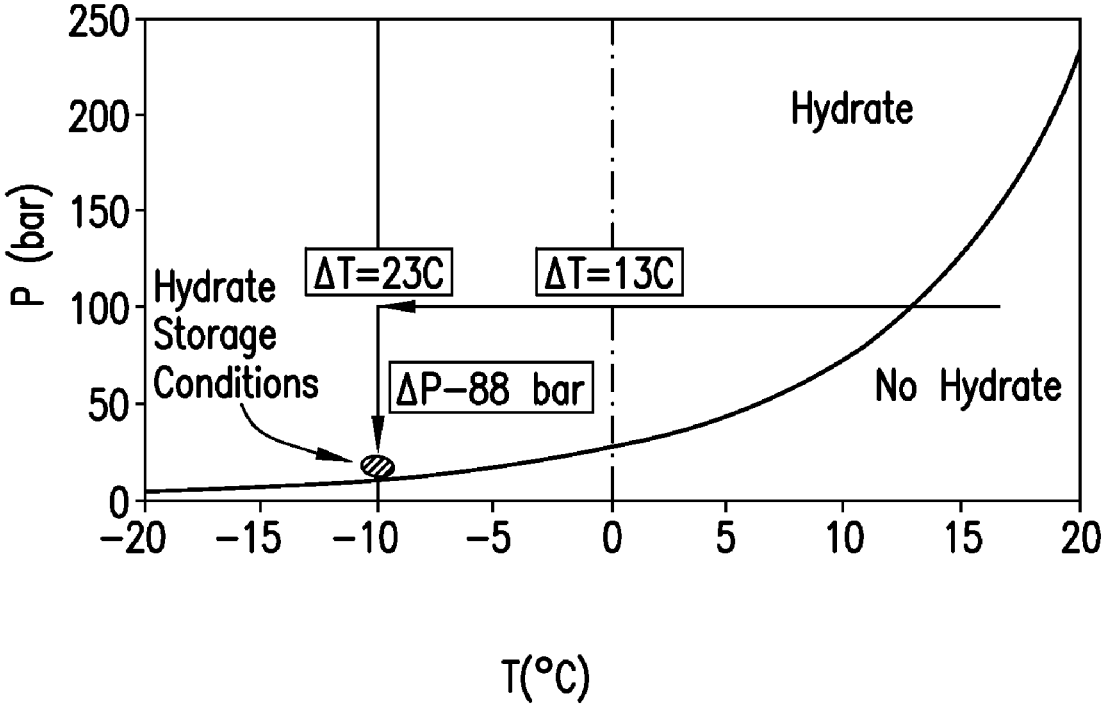
FIG. 1: Typical calculated Phase boundary (using HWHyd software from Gas Hydrate Research Center at Heriot-Watt University) and thermal-pressure stability region for methane hydrate. Arrows show the procedure and pathways for hydrate formation and completion, temperature decreasing and pressure release.

The present invention solves the above problems since it has now been found that drawbacks, for example occurring in connection with slurry and self-preservation methods, can be avoided with use of low dose hydrate stabilizers.

According to an embodiment of the present invention the high gas-content hydrates are kept and stored in their thermodynamic stability zone and can be used to transport different gases or gas mixtures of different compositions (e.g. in the case of natural gas) under relatively mild operating conditions. The pressures according to the present invention, under which the hydrates are transported, are preferred to be in the range of 8-16 bar, but any other temperature and pressure condition, under which hydrates prepared according to the present invention can be stored and kept with an acceptable level of stability, are also within the scope of the invention.

In order to store the gases efficiently and safely by means of hydrates, chemical substances and formulations are used that prohibit the dissociation of hydrates. The substances are herein referred to as "low dose hydrate stabilizers". The compounds increase the gas content of hydrates through increasing the gas solubility, and also have the ability to avoid the dissociation of hydrates under operational conditions close to the phase boundary curve which is equivalent to the hydrate thermodynamic stability zone (a bit to the left of the phase boundary curve). High concentrations of these stabilizers (mostly 1% or higher for example for cellulosic ethers) form viscous solutions, disrupting the diffusion of gas into the solution and the consequent hydrate-formation.

That is the reason why according to the present invention these compounds are preferably used in concentrations of less than 1% w/w, however if the high-viscosity problem is solved in some way, the compounds can also be used in relatively higher concentrations up to 5% without the formation of a gel phase.

Some of the properties of compounds used as low dose hydrate stabilizers according to the invention are the following:

1—They stabilize hydrates at low pressures and prevent their dissociation.
2—They increase the gas solubility in comparison to conventional hydrate formation systems.
3—They have no inhibition effects or their inhibition effects are negligible, or in case they have a so-called inhibition effect they should be used together with a suitable promoter.
4—These compounds are completely water soluble, or have relatively high water solubility.
5—They are chemically stable in the operating temperature range, do not dissociate considerably and can be recycled and used repeatedly.
6—Their presence, preferably at low doses, leads to the stabilization and preferably does not considerably change the thermodynamic behavior of hydrates.
7—These compounds are preferred to be environmental friendly.

Some of the compounds having the above mentioned properties, and showing the desired effects, according to the desired subject matter of the invention are mentioned below.

The "low dose hydrate stabilizers" according to the invention used to stabilize hydrates are selected from cellulosic ethers (e.g. hydroxy alkyl cellulose derivatives, like for example hydroxyethyl cellulose, hydroxypropyl cellulose, hydroxypropyl methylcellulose, carboxymethylcellulose), polyalkylene glycols (e.g. polypropylene glycol, polyethylene glycol), polyamines (e.g. polyethylene amine, polypropylene amine, polyaniline, ethoxylated polyamines), polyvinylpyrrolidone, polyamides, polypeptides (e.g. polyaminoacids like for example polylysine), ethoxylated fatty amines, ethoxylated fatty acids; sulphonated, phosphonated or ethoxylated water soluble polymers or mixtures of the above mentioned compounds. Optionally a low-dose hydrate promoter can also be present.

These organic compound tend to have both hydrophillic and hydrophobic portions, which allows them to interact with both the water and the gas, particularly when the gas a hydrocarbon.

In case cellulosic ethers are used as stabilizers, a molecular weight of 5,000 to 1,000,000 is preferred.

In case polyalkylene glycols are used as stabilizers, a molecular weight of 300 to 300,000 is preferred.

The invention may further comprise a hydrate promoter like for example sodium dodecyl sulphate.

The present invention further relates to a process for the formation and stabilization of hydrates of different gases and volatile compounds (e.g. methane, ethane, propane, iso-butane, acetylene, ethylene, cyclopropane, natural gases or any other mixtures of hydrocarbons or other volatile compounds like $O_2$, $N_2$, $CO_2$, $SO_2$, $SO_3$, noble gases, $H_2S$, nitrogen oxides and $H_2$ or mixtures thereof).

The process according to the invention uses high to medium pressures of gases (the hydrate of which is desired) over aqueous solutions and alternatively solutions in other organic or inorganic solvents comprising one or more of the mentioned stabilizers in a suitable dose.

The formation pressure may vary depending on the type of the gas (e.g. 120 bar for natural gas). The hydrates formed in this way can be stored under relatively mild temperature and pressure conditions. The hydrate formation temperature depends on the type and nature of the gases and the phase diagrams thereof, and is preferably about 4° C. for almost all of the gases.

Hydrate inhibitors like Polyvinyl pyrrolidone (PVP) and derivatives thereof, or other hydrate inhibitors leading to the very slow formation of the desired gas hydrates are also applicable as hydrate stabilizers, in case they are used together with a suitable hydrate promoter (e.g. Sodium dodecyl sulfate) that compensates the reduction of the hydrate formation rate.

The stabilization and storage of the hydrates can be performed under different pressures of 8 to 15 bar, depending on the nature of the gas or the composition of the gas mixtures (e.g. 15 bar in the case of methane and natural gas hydrates, and 7 bar for carbon dioxide hydrate). The stabilization and storage temperatures are in the range of from minus 5 to minus 10° C. depending on similar conditions.

The most preferred stabilizers are hydroxyethyl cellulose, hydroxypropyl cellulose, hydroxypropyl methylcellulose and/or polyethylene glycol or any mixtures thereof.

The concentration of low dose stabilizers in aqueous solutions is 0.1-1.0% (W/V), preferably 0.3-0.8% (W/V) and most preferably 0.5% (W/V). So one of the most preferred composition contains at least 0.5% of hydroxyalkylcellulose.

The preferred concentrations of polyalkylene glycol stabilizers are 0.3% to 1.2% by weight, preferably 0.4% to 0.9% by weight and most preferably 0.6% wt of polyethylene glycol.

In formulations and mixtures of stabilizers the sum of the concentrations of cellulosic ethers including hydroxyethyl cellulose, hydroxypropyl cellulose and hydroxypropyl methylcellulose is about 0.3% to 0.9% wt, preferably 0.4% to 0.7% wt and most preferably 0.5% wt.

In formulations and mixtures of the stabilizers the concentration of polyalkylene glycols is about 0.1% to 0.5% wt, preferably 0.1% to 0.3% wt and most preferably 0.2% wt.

In formulations and mixtures of hydroxyethyl cellulose stabilizers the concentration of this species is 0.1% to 0.4% wt, preferably 0.2% wt, the concentration of hydroxypropyl cellulose is 0.1% to 0.2% wt and preferably 0.1% wt, and the concentration of hydroxypropyl methyl cellulose is 0.1% to 0.3% wt and preferably 0.1% wt, and the concentration of polyethylene glycol is 0.1% to 0.4% wt and preferably 0.2% wt.

It is noteworthy that the higher the molecular weight of the polymers is, the lower its preferred weight percent will be in the used formulation. For instance the optimum amount of hydroxypropyl cellulose with a molecular weight of 1,000,000 Daltons is required to have a concentration of 0.1% wt in the formulation, while in case the molecular weight is 100,000 Daltons, the required concentration should be around 0.2% wt.

The low dose stabilizers of the present invention do not only increase the lifetime of the hydrates, but they also considerably increase the gas content of the hydrates.

After the formation of the gas hydrates (of e.g. methane, natural gas and carbon dioxide hydrates), and according to the preferred method of the present invention, the temperature is initially decreased to temperatures lower than the melting point of ice (i.e. minus 5 to minus 10° C.), and the pressure is then reduced (depending on the nature and composition of the gas mixtures) reversibly or irreversibly, preferably in a reversible manner (e.g. to 12-15 bar and preferably 5 bar for methane and/or natural gas, 7-9 bar and preferably 8 bar for carbon dioxide). The pressure release is most preferred to be performed in a reversible manner.

The hydrates formed according the above-mentioned method of the present invention or any variation thereof can be easily stored in the mentioned thermal and pressure conditions. It should of course be noted that the pressure drop should be such that the operational conditions do not reach those outside the stability zone of the hydrate. In such a case (e.g. 12 bar and minus 5° C. for methane and/or natural gas hydrates), hydrates will not be thermodynamically stable.

Using very low temperatures (e.g. −30° C.) will also increase the amount of ice-phase and also the rate of hydrate to ice conversion.

The experimental results prove that in the absence of stabilizers according to the invention dissociation of hydrates and their conversion of all or a part of them to ice occur. In such cases (after the establishment of equilibrium and stabilization of the system pressure) the formed hydrates will have very low gas contents (this can be observed regarding the fact that such hydrates does not burn). Hence, the clear advantages of the invention can be proved.

The low dose stabilizers of the present invention not only stabilize the hydrates but also increase the gas content of hydrates. The mentioned stabilizers make it possible to store the formed hydrates at relatively higher temperatures and lower pressures (see FIG. 1). It is assumed (although the present invention is not bound to that theory) that the major role of the stabilizers is to strengthen the hydrate lattices by their long polymeric chains, which leads to its long and high stability, and the so formed hydrates can be kept for several days in 2-4° C. in a refrigerator.

In fact these stabilizers induce the ability that hydrates that are formed under severe temperature and pressure conditions, be kept in milder temperatures and pressures, near the phase diagram conditions (the dashed sections in FIG. 1), for unlimited periods of time. Outside the stability zone in the phase diagrams, the hydrates are naturally unstable and are easily dissociated, however in the presence of the stabilizers of the present invention the dissociation rate of the hydrates is very low. The results revealed that the mentioned dissociation rate is so low that, depending on the distance and conditions of transportation, the hydrates formed according to the embodiments of the present invention can be stored even outside the inherent stability zone of conventional hydrates (e.g. at 15 bar and −5° C. for methane and natural gas hydrates).

The stabilizers of the present invention also lead to an increase in the density of $CO_2$ hydrates, which provides the opportunity to keep the hydrates of this gas under mild operational conditions under low depths of water in pools, lakes, seas, and oceans (under depths the exerted pressure of which is equivalent to 13 bar). By doing so, it will become possible to eliminated and store this greenhouse gas in the form of hydrates.

The stability conditions of $CO_2$ hydrates in the presence of the mentioned stabilizers is 8 bar and −10° C. The so-stored $CO_2$ can also be restored and used if necessary.

Regarding the fact that the mentioned stabilizers do not change the phase diagram of the hydrates, their effect should be based on the kinetics of the said hydrate formation and dissociation processes.

Based on this fact, one should distinguish between the low dose hydrate stabilizers of the present invention and kinetic hydrate promoters (unlike the so-called promoters), the stabilizers of the present invention do neither facilitate the formation of hydrates, nor do they have a considerable kinetic inhibition effect on the formation of hydrates. In fact the major function of these compounds is the long-term (practically infinite) stabilization of the formed hydrates and the considerable slowing of the hydrate dissociation in a range of −10-+10° C. and even outside the stability zone of hydrates. As a result the mentioned cultrate hydrate stabilizers can be used in the following cases:

a) Stabilization of different hydrate structures of I, II, H in the stability and metastability zones, b) Formation of hydrates of higher gas contents of gases, or hydrocarbons forming the hydrates, c) Increasing the density and physical stability of hydrates, d) storing $CO_2$ in the form of stable hydrates, e) decreasing the dissociation rate of hydrates at conditions out of their stability region, outside the hydrate stability zone, or in any other applications or effects in the field of hydrates.

The hydrates formed according to the method, using the formulations of present invention, dissociate rapidly in a temperature range of 30-35° C., completely releasing their gas content, for further applications, and the stabilizer solutions can be recovered and used for virtually unlimited runs.

The dashed elliptical zone in FIG. 1 shows the storage conditions for methane hydrates, which are equivalent to a temperature of −10° C. and pressure of 13 bar.

The method for the application of the low dose stabilizers is as follows:

The solution of the stabilizer in distilled water is first entered into a high pressure reactor, where it is mixed with the gases of desire and pressurized with the same gas to reach the optimum pressure (depending the nature and chemical composition of the gas, e.g. 120 bar for methane and 50 bar for $CO_2$).

The hydrate memory (i.e. the hydrogen bond content of water, caused due to the hydrophobic interactions between the gas molecules and the polar water molecules) can also be taken advantage of, since this property facilitates the formation of hydrates and reduces the over pressure. However the method and formulations of the present invention do not depend on the presence of hydrate memory effect as a prerequirement.

Figure 2:
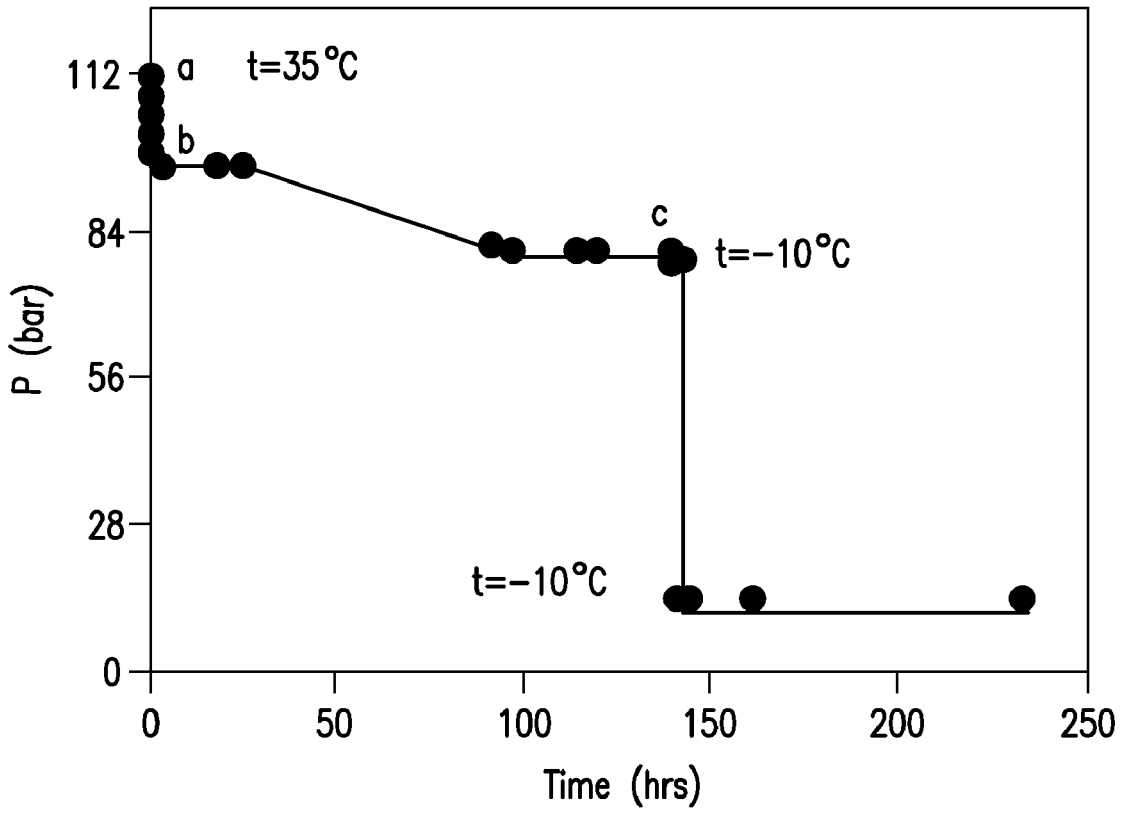
FIG. 2: Long-term stability of methane hydrate in the absence of the stabilizers of the present invention. The hydrate was formed at 4° C., P~120 bar. The temperature was then reversibly decreased to −10° C., and finally the pressure was dropped to about P~13 bar.

The next step includes the reduction of the system temperature down to 1-4° C. (point b in FIG. 2). With the onset of the hydrate formation the system pressure starts to drop, and when the hydrate formation is complete the pressure becomes constant. In fact all other thermodynamic variables of the system become constant at this point. So if the system variables are monitored using a computer, throughout the process, the mentioned stability in their values is an indication of the completion of the hydrate formation. (point c, FIG. 2).

In a next step, the system temperature is reduced to (−10)-(+5)° C., preferably to −10° C. and the pressure is reduced down to 6-14 bar (depending on the nature and composition of the gas; e.g. 13 bar for methane and/or natural gas and 7 bar for $CO_2$) in a reversible way and preferably with a rate of 15-20 psia/min. The hydrates formed through the proposed method prove to have the mentioned superiorities over the conventionally formed hydrates.

The most preferred stabilizers comprise hydroxyethyl cellulose (M.W=5000-200,000 Daltons) hydroxypropyl cellulose (M.W=100,000-1000,000 Daltons) hydroxypropyl methylcellulose, carboxymethyl cellulose and polyethylene glycol (M.W=300-30,000 Daltons) or any mixtures thereof in a composition range of 0.1% to 1% (W/V).

The preferable aqueous formulation comprises hydroxyethyl cellulose (0.1-0.4% (W/V)), hydroxypropyl cellulose (I.W=100,000, 0.1-0.3% (W/V)) hydroxypropyl methylcellulose (M.W=200,000, 0.1-0.3% (W/V)) and poly ethylene glycol (M.W=30,000, 0.1-0.4% (W/V)).

The most preferable composition comprises, hydroxyethyl cellulose (0.2% (W/V)), hydroxypropyl cellulose (0.1% W/V), hydroxypropyl methylcellulose (0.1% (W/V)) and polyethylene glycol (0.2% (W/V)).

The hydrates formed in the presence of the hydrate stabilizers of the present invention, especially cellulosic ether stabilizers, have very good physical properties, and cannot easily be broken, which is a virtue in the storage procedures.

The hydrates can be formed in the shape of cubes or spheres of different dimensions. The dimensions of the structures can be in the range of 10 to 20 cm in the case of cubic structures or 15-30 ml in the case of spheres. The shaping is performed after the hydrate slurry becomes paste like, or in the case of production of powder hydrates a pelletizer performs it.

In case of storing spherical hydrates, it is preferred to use spheres of two dimensions. The small spheres, in this case can fill the empty spaces between the large ones.

EXAMPLES

We mention some examples to indicate the applicability of the embodiments of the invention. However the gist of the present invention is by no means limited to the examples below.

Comparative Example

Formation of Hydrates in the Absence of Stabilizers 100 milliliters of distilled water was entered into a 300 ml high pressure reactor (Parr Instruments, HC. 276), and the pressure was then increased up to 120 bar, using methane gas (In this case the hydrate memory is removed at 34° C. for 4 hours [This is done just to show the efficiency of the method; and is not necessary in real-time experiments, knowing that the hydrate memory effect may also facilitate the process]). The system temperature is then reduced down to 4° C. with a rate of 1° C./min. The pressure-time, temperature-time and pressure-temperature changes are stored in a computer throughout the process. After the formation and completion of the hydrates, the system temperature is reduced to −10° C., and its pressure is preferably reversibly reduced down to 13 bar (with a rate of 1.5 bar/min).

The hydrates produced in this way can be stored for 2-3 weeks under the storage conditions. For the purpose of releasing the gases (in this example methane), the system temperature is increased to 30° C. (The gas content of the hydrate can be calculated by measuring the amount of the released gas).

Example 1

Application of the Low Dose Stabilizers of the Present Invention

Figure 3A:
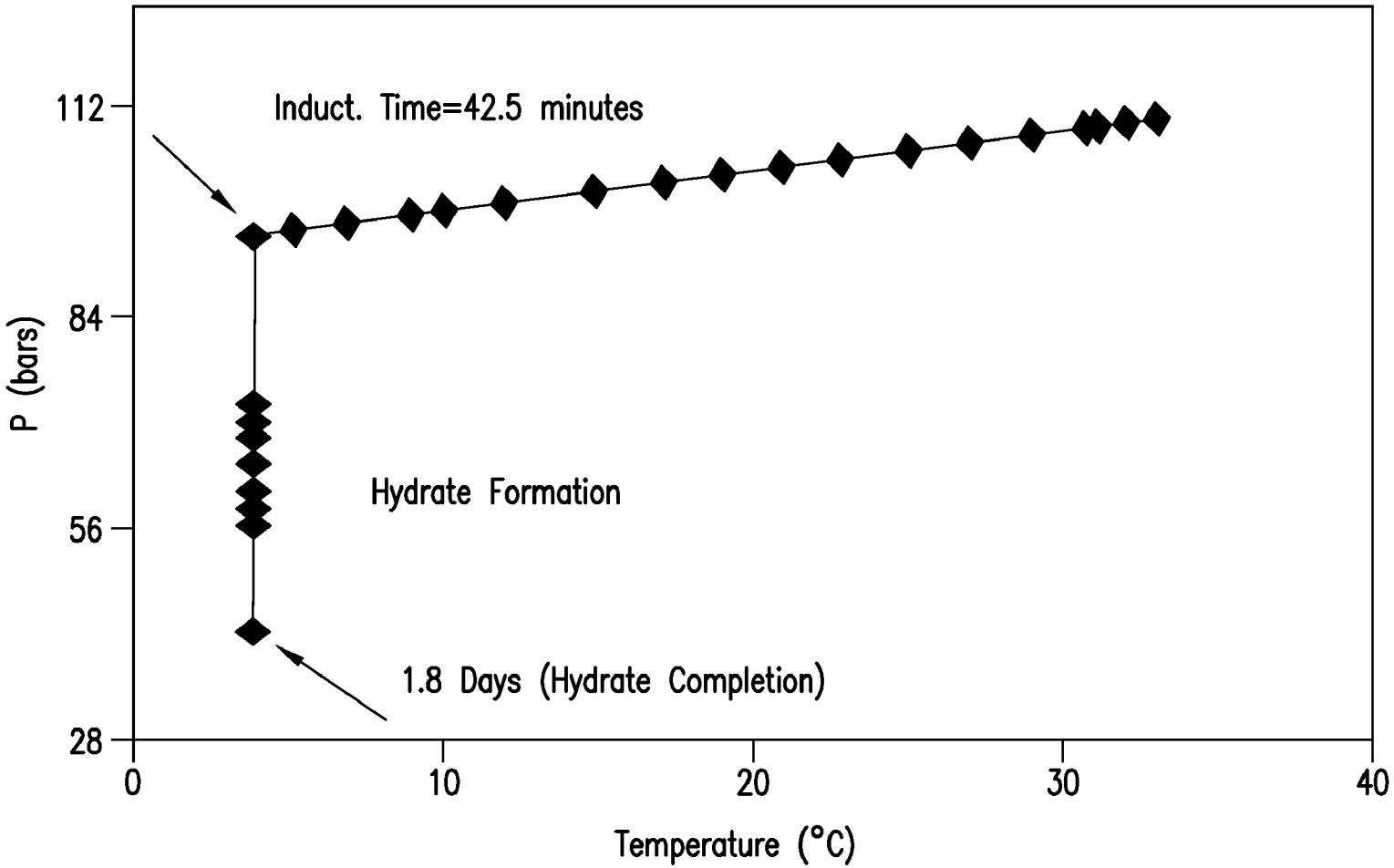
FIG. 3*a*: Long-term stability of methane hydrate in the presence of stabilizer (hydroxyethyl cellulose, 0.5% (W/V)). Hydrate was formed at 4° C., P~120 bar. The temperature was then reversibly decreased to −10° C., and finally the pressure was dropped to about P~13 bar.
Figure 3B:
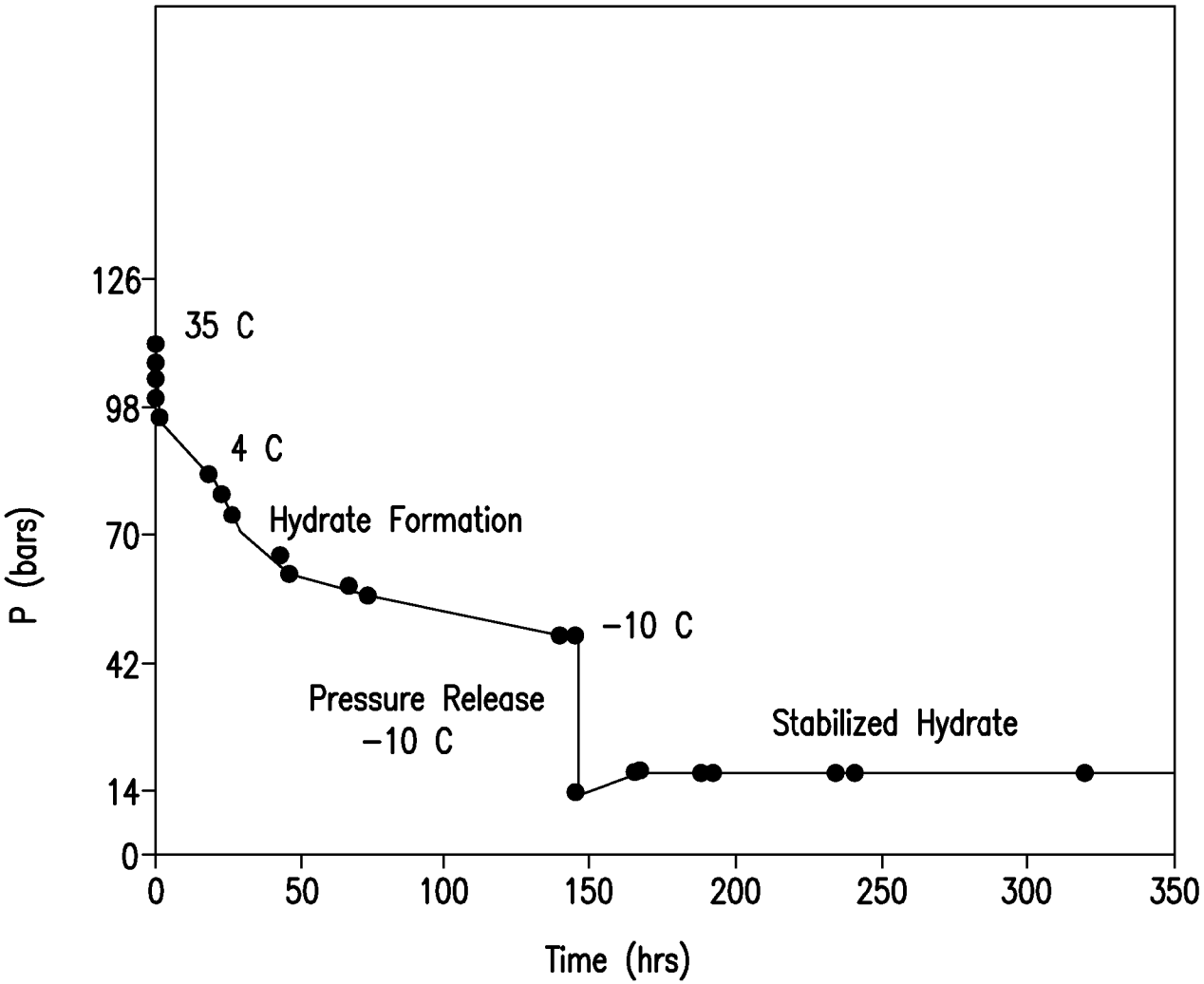
FIG. 3*b*: Pressure-Temperature diagram showing the cooling step, starting and completion of methane hydrate formation in the presence of hydroxyethyl cellulose, 0.5% (W/V)) as low-dosage hydrate stabilizer.

A mixture of 100 ml of distilled water containing 0.5% (W/V) of hydroxyethyl cellulose (HEC), as a preferred low dose stabilizer, was prepared by stirring the solution for 20 hours prior to use, to completely homogenize the solution. The solution was entered into the same reactor as the example above and it was pressurized up to 110 bar using methane. The other steps were followed according to the example above. The formed hydrate proved to be much more stable than that of the above comparative example (even after 20 weeks). FIG. 3, illustrates the pressure temperature behavior of the system.

This figure shows that the gas content of the hydrate is more than that of the above comparative example.

Next, it is seen that the hydrate is stable even after long periods of time (Here after 20 weeks) even after reversibly reducing the pressure down to 13 bar. This proves the application of the hydrates in gas transportation to be economic, especially due to their stability under relatively milder temperature and pressure conditions.

In fact the presence of a hydrate stabilizer (which is HEC in the present example), increases the gas content of the hydrates up to 61% (under operation formation conditions of p=110 bar, T=4° C., and storage conditions of −10° C. and 15 bar and the methane volume to the hydrate volume is increased from 31% to 105% (V/V). The maximum theoretic gas content for structure I is taken to be about 172 $m^3$/volume unit of hydrate, and the compressibility factor (z) is calculated using the Peng-Robinson equation.

Example 2

This is the Repetition of Example 1 for Natural Gas Under the Same Conditions

TABLE 1

Composition of natural gas used in the experiment

| Molecule | $CH_4$ | $C_2H_4$ | $C_3H_7$ | i-Butane | n-Butane | i-Pentane | n-Pentane | $C_6$ | $N_2$ | $CO_2$ | $H_2O$ |
|---|---|---|---|---|---|---|---|---|---|---|---|
| Volume % | 72.92 | 3.92 | 1.33 | 0.275 | 0.367 | 0.0583 | 0.0417 | 0.0083 | 3.75 | 0.667 | 16.6 |

All the steps were followed accordingly (P=110 bar, T=4° C. for formation) and (P=14 bar, T=−10° C. for storage), and comparing with the same conditions of example 1 for natural gas, the gas content of the hydrate was found to be increased up to 3.5 times (from 31.4% (V/V) in the absence of the hydrate stabilizer (under P=82 bar, and T=4° C.) to 110% (V/V)).

Example 3

Repetition of Example 1 in the Presence of Promoter

A solution of 80 ml of distilled water containing 500 ppm sodium n-dodecyl sulfate (SDS), as the promoter for hydrate formation, was entered into the same reactor as the example 1 and it was pressurized up to 100 bar using methane. After cooling to 4° C. and consuming methane (due to hydrate formation), system pressure reached to 45 bar. Then, 20 ml of hydroxyethyl cellulose (HEC) solution (2.5% W/W) was inserted into the stirring reactor by means of methane forward pressure so that the system was again pressurized up to 90 bar (in order to increase the gas content and completing the hydrate). The other steps were followed according to example 1. Results showed that the gas content of the hydrate is more than that of example 1. It was observed that the hydrate is stable for long periods of time (here after 20 weeks) even after reversibly reducing the pressure down to 15 bar.

In fact in the presence of both of the hydrate promoter (which is SDS in the present invention) and the hydrate stabilizer (which is HEC in the present invention), the rate of hydrate formation increases about 30 times (in comparison to example 1), the gas content of the hydrate increases up to 76% (under operation formation conditions of p=100 bar, T=4° C., and storage conditions of −10° C. and 15 bar) and the stored methane volume per hydrate volume is increased up to 130.

Example 4

Repetition of Example 3 Using Polyvinyl Pyrrolidone as the Stabilizer

Polyvinyl pyrrolidone (PVP) is well known as hydrate kinetic inhibitor, however once the hydrate is formed, the compound is found to have a much higher stabilizing effect on the formed hydrate which is the reason behind the great desire to use it as a hydrate stabilizer and trying to overcome its inhibition effects. It is found that using sodium dodecyl sulfate (SDS) as the effective promoter, not only is it possible to overcome the inhibiting effects of PVP, but it can also be used as a very good hydrate stabilizer to be applied as an efficient low-dose hydrate stabilizer.

A solution of 80 ml of distilled water containing 500 ppm (0.05% W/W) of sodium n-dodecyl sulfate (SDS) as the promoter for hydrate formation, was entered into the same reactor as the example 4 and it was pressurized up to 115 bar using methane. After cooling to 4° C. and consuming methane (due to hydrate formation), system pressure reached 41.5 bar (after about 15 hrs). Then, 20 ml of polyvinyl pyrrolidone (PVP, average MW~1300000) solution (2.5% W/W) was inserted into the stirring reactor by means of methane forward pressure so that the system was again pressurized up to 82 bars (in order to increase the gas content and completing the hydrate). The other steps were followed according to the example 1. Results showed that a rigid hydrate was produced and its mechanical resistance was much better than the hydrate of Example 3. Furthermore, gas content of the hydrate is 47% (operation conditions: P=100 bar, T=4° C., storage condition: −10° C., 15 bar). It was observed that the hydrate is stable even after long periods of time (here after 20 weeks) even after reversibly reducing the pressure down to 15 bar. One should, however, note that in the case of application of PVP (a well-known kinetic hydrate inhibitor), which normally leads to the very low rates of hydrate formation, together with SDS (a well-known hydrate promoter) the formed hydrate is very rigid and stable after the formation, while the gas content is 47%.

The following table compares the results of control experiments with the main experiments.

| Compound | P initial at 35.0° C. | P at 4.0° C. | P after hydrate completion | Time for hydrate completion | Gas content of hydrate | Rigidity |
|---|---|---|---|---|---|---|
| SDS (0.05% W/W) | 103 | 90 | 45 | ~3 hrs | — | Unrigid (Slush) |
| PVP* (0.5% W/W) | 118 | 100 | 60 | >6 days | 45% | very hard and rigid |
| SDS/HEC# (0.05/0.5% W/W) | 116 | 100 | 60 | >2 days | 76% | slightly rigid |
| SDS/PVP* (0.05/0.5 W/W) | 116 | 96 | 50 | ~5 hrs | 47% | rigid |

*PVP Average M.W~1,300,000, The solution of SDS and PVP was prepared and used directly at the start of experiment.
#HEC, Average M.W~200,000, the solution of SDS and HEC was prepared and used directly at the start of experiment.

In fact the presence of a hydrate promoter (which is SDS in the present invention) and the hydrate stabilizer (which is PVP in the present invention), the rate of hydrate formation increases about 38 times (in comparison to the control experiment i.e. in the absence of SDS promoter). Furthermore, gas content of the hydrate was about 47% (under operation formation conditions of p=100 bar, T=4° C., and storage conditions of −10° C. and 15 bar).

What is claimed is:

1. A composition for increasing stability and gas content of gas hydrates comprising:

a. water;

b. a gas; and c. a stabilizer that is an organic compound having both hydrophillic and hydrophobic portions, wherein the stabilizer results in an increase in at least one of stability or gas content of the gas hydrate.

2. The composition according to claim 1, further comprising a hydrate promoter.

3. The composition according to claim 2, wherein the hydrate promoter is sodium dodecyl sulphate.

4. The composition according to claim 2, further comprising a hydrate inhibitor.

5. The composition according to claim 4, wherein the hydrate inhibitor is polyvinylpyrrolidone.

6. The composition according to claim 1, wherein the hydrate stabilizer is selected from the group consisting of cellulosic ethers, polyalkylene glycols, polyamines, polyvinylpyrrolidone, polyamides, polypeptides, ethoxylated fatty amines, ethoxylated fatty acids; sulphonated, phosphonated or ethoxylated water soluble polymers and mixtures thereof.

7. The composition according to claim 1, wherein the hydrate stabilizer is selected from the group consisting of hydroxy alkyl cellulose derivative, polypropylene glycol, polyethylene glycol, polyethylene amine, polypropylene amine, polyaniline, ethoxylated polyamines, polyaminoacids, and combinations thereof.

8. The composition according to claim 1, wherein the hydrate stabilizer is selected from the group consisting of hydroxyethyl cellulose, hydroxypropyl cellulose, hydroxypropyl methylcellulose, carboxymethylcellulose and combinations thereof.

9. The composition according to claim 1, wherein the stabilizer is a cellulosic ether.

10. The composition according to claim 1, wherein the stabilizer is hydroxyalkyl cellulose.

11. The composition according to claim 1, wherein the stabilizer is hydroxyethyl cellulose and/or hydroxypropyl methylcellulose.

12. The composition according to claim 9, wherein the stabilizer has a molecular weight of 5,000 to 1,000,000.

13. The composition according to claim 1, wherein the hydrate stabilizer is present in an amount of 0.1 to 1% by weight in relation to the amount of water.

14. The composition according to claim 1, wherein the hydrate stabilizer is present in an amount of 0.3 to 0.8% by weight in relation to the amount of water.

15. The composition according to claim 1, wherein the hydrate stabilizer is present in an amount of 0.5% by weight in relation to the amount of water.

16. The composition according to claim 13, wherein the hydrate stabilizer is cellulose ether.

17. The composition according to claim 1, wherein the hydrate stabilizer is a polyalkylene glycol.

18. The composition according to claim 1, wherein the hydrate stabilizer is polyethylene glycol.

19. The composition according to claim 1, wherein the hydrate stabilizer is a polyalkylene glycol having a molecular weight of 300 to 300,000.

20. The composition according to claim 1, wherein the hydrate stabilizer is polyalkylene glycol and is present in an amount of 0.3 to 1.2% by weight.

21. The composition according to claim 20, wherein the hydrate stabilizer is 0.4 to 0.9% by weight.

22. The composition according to claim 21, wherein the hydrate stabilizer is 0.6% by weight in relation to the amount of water.

23. The composition according to claim 1, wherein the hydrate stabilizer is polylysine.

24. The composition according to claim 1, wherein the hydrate stabilizer is a mixture of polyethylene glycol, hydroxyethyl cellulose, hydroxypropyl cellulose, and hydroxypropyl methyl cellulose, wherein the concentration of hydroxy ethyl cellulose is 0.1%-0.4% by weight, the concentration of hydroxypropyl cellulose is 0.1%-0.2% by weight, the concentration of hydroxypropyl methyl cellulose is 0.1%-0.3% by weight and the concentration of polyethylene glycol is 0.1% to 0.4% by weight in relation to the amount of water.

25. The composition according to claim 24, wherein the concentration of hydroxy ethyl cellulose is 0.2% by weight, the concentration of hydroxypropyl cellulose is 0.1% by weight, the concentration of hydroxypropyl methyl cellulose is 0.1% by weight and the concentration of polyethylene glycol is 0.2% by weight in relation to the amount of water.

26. The composition according to claim 1, wherein the stabilizer comprises 0.1 to 1.2% by weight of polyalkylene glycols in relation to the amount of water.

27. The composition according to claim 26, wherein the stabilizer comprises 0.4 to 0.9% by weight in relation to the amount of water.

28. The composition according to claim 27, wherein the stabilizer comprises 0.6% by weight of polyalkylene glycol in relation to the amount of water.

29. The composition according to claim 1, wherein the gas is selected from the group consisting of methane, ethane, propane, iso-butane, acetylene, ethylene, cyclopropane, natural gases or any other mixtures of hydrocarbons or other volatile compounds like $O_2$, $N_2$, $CO_2$, $SO_2$, $SO_3$, noble gases, $H_2S$, nitrogen oxides and $H_2$ and mixtures thereof.

30. The composition according to claim 1, wherein the gas is selected from the group consisting of hydrocarbons, natural gases, hydrogen, noble gases and carbon oxides and mixtures thereof.

31. The composition according to claim 1, wherein the gas is methane.

32. The composition according to claim 1, wherein the gas is carbon dioxide.

33. The composition according to claim 1, wherein the gas is natural gas.

34. A process for production of gas hydrates comprising the steps of a. dissolving in distilled water a stabilizer that is an organic compound having both hydrophillic and hydrophobic portions, wherein the stabilizer results in an increase in at least one of stability or gas content of the gas hydrate, b. mixing the stabilizer solution with a gas to obtain a mixture, c. pressurizing said mixture with the same gas, d. reducing temperature to 1-4° C. to form hydrates, e. adjusting the temperature to (−10° C.)-(+5° C.), and f. reducing the pressure to a desired storage pressure.

35. The process according to claim 34, wherein the gas is methane or natural gas and the storage pressure is 13 bar.

36. The process according to claim 34, wherein the gas is methane or natural gas and hydrate formation takes place at 120 bar.

37. The process according to claim 34, wherein the gas is carbon dioxide and the storage pressure is 7 bar.

38. The process according to claim 34, wherein the gas is carbon dioxide and hydrate formation takes place at 50 bar.

39. A method of stabilizing gas hydrates, wherein a stabilizer is added to the mixture selected from the group of cellulosic ethers, hydroxy alkyl cellulose derivatives, polyalkylene glycols, polyamines polyvinylpyrrolidone, polypeptides, ethoxylated fatty amines, ethoxylated fatty acids; sulphonated, phosphonated or ethoxylated water soluble polymers or mixtures of the above mentioned compounds.

40. A method for the stabilization of gas hydrates comprising the steps of a. dissolving a hydrate promoter in water, b. applying high gas pressure to the solution until hydrate forming has finished, c. adding a solution of a hydrate inhibitor.

e. adjusting the temperature to (−10° C.)-(+5° C.), and f. reducing the pressure to the suitable storage pressure.

41. The method according to claim 40, wherein the hydrate promoter is sodium dodecyl sulphate.

42. The method according to claim 40, wherein the hydrate inhibitor is polyvinylpyrrolidone.

* * * * *